United States Patent [19]

Ichida et al.

[11] Patent Number: 4,771,626

[45] Date of Patent: Sep. 20, 1988

[54] APPARATUS FOR ROLL-CHANGING

[75] Inventors: Kozaburo Ichida; Susumu Yamaguchi; Bunichiro Chikazawa; Hironobu Hayashi; Teruo Matsushita; Akinobu Yoshiura; Shinobu Sanematsu, all of Kitakyushu, Japan

[73] Assignee: Nippon Steel Corporation, Tokyo, Japan

[21] Appl. No.: 25,806

[22] Filed: Mar. 13, 1987

[30] Foreign Application Priority Data

Mar. 14, 1986 [JP] Japan ..... 61-56260

[51] Int. Cl.[4] ..... B21B 31/08

[52] U.S. Cl. ..... 72/239

[58] Field of Search ..... 72/237, 238, 239

[56] References Cited

U.S. PATENT DOCUMENTS

| | | | |
|---|---|---|---|
| 3,566,498 | 3/1971 | Kato et al. | 72/239 X |
| 3,638,468 | 2/1972 | Fukui et al. | 72/239 X |
| 3,738,142 | 6/1973 | Adair | 72/239 |
| 4,510,783 | 4/1985 | Römmen et al. | 72/239 X |

FOREIGN PATENT DOCUMENTS

| | | |
|---|---|---|
| 51-114363 | 10/1976 | Japan . |
| 60-56564 | 12/1985 | Japan . |

*Primary Examiner*—Robert L. Spruill
*Assistant Examiner*—Steven B. Katz
*Attorney, Agent, or Firm*—Wenderoth, Lind & Ponack

[57] ABSTRACT

A roll-changing apparatus for use with a rolling machine including a roll-changing truck, a roll-exchanging truck, a roll-setting truck and a roll rack facility which are used to transport sets of rolls in conjunction with one or more racks having vertically spaced-apart sets of rails for supporting and transferring the rolls. The rolls can be transferred by sliding them between individual racks mounted on each of the roll-changing truck, the roll-exchanging truck and the roll rack facility or a single rack can be rolled from the roll rack facility to the roll-exchanging truck and then to the roll-changing truck for transferring the rolls to and from the rolling machine. The roll-setting truck includes a set of vertically movable rails for aligning with a respective set of rails of a rack mounted on the roll rack facility. The roll rack facility includes a plurality of racks, each of which holds a set of used or reconditioned rolls.

12 Claims, 5 Drawing Sheets

APPARATUS FOR ROLL-CHANGING

BACKGROUND OF THE INVENTION

1. Field of the Invention

The present invention relates to an apparatus for roll-changing.

2. Description of the Prior Art

Reversing mills and tandem mills are generally known as rolling mills. With respect to one stand thereof, 2-high rolls, 4-high rolls, 6-high rolls and 20-high rolls are common mill systems.

The old conventional method for changing rolls in a 4-high roll stand, comprised, for example, removing work rolls from the mill stand one by one and transporting them in a two high configuration.

Recently, the steps of changing rolls in a 4-high mill have comprised using a roll-changing truck to transport the work rolls in a two high configuration, and in a 6-high mill, transporting the work rolls and intermediate rolls, totalling four rolls, in a four high configuration.

In the conventional method for changing the rolls of a rolling machine employing a roll-changing truck, the steps of loading of the reconditioned rolls from a roll storage shed within the roll shop onto a roll-changing truck and the unloading of the worn rolls from the roll-changing truck at the storage shed have been carried out by means of a dedicated hoist employing a crane. Moreover, as described in Japanese published unexamined patent application No. 114363/1976, those operations have been carried out by a combination of a conveyor and a hoist, and the rolls are placed at rest one high on a rack at the roll storage shed. Furthermore, Japanese published examined patent application No. 56564/1985 discloses a roll-changing device in which one set of top and bottom work rolls and top and bottom intermediate rolls are transported on rails, and the rolls are placed one high on a rack at the roll storage shed. In this case, in changing of one set of rolls for another, the crane can hoist only one or two rolls at most.

According to the aforementioned conventional method, during transport of the rolls, it is necessary for someone on the ground to give a signal to the crane, and when the roll-changing truck and the roll storage shed are separated it is further necessary for a truck to travel between the two locations. Still further, the maximum number of the rolls that can be carried at one time is only one or two and, accordingly, much labor and time have been required for carrying the set of four rolls (two working rolls and two intermediate rolls) of the rolling machine at one time.

Still further, according to such a conventional method of using a crane for carrying the rolls between the roll-changing truck and the roll storage shed within the shop, it was necessary for a hooking operator to be able to work freely so that the roll shop inevitably occupied a large area.

SUMMARY OF THE INVENTION

A primary object of the present invention is to provide a roll-changing method enabling unmanned transport of rolls between a roll-changing truck and a roll storage shed.

Another object of the present invention is to provide a roll-changing apparatus combining the capability of simultaneously transporting a plurality of rolls by means of a truck with a vertical rack type roll storage facility.

The other objects and features of the present invention will be understood from the following description and the drawings.

BRIEF DESCRIPTION OF THE DRAWINGS

The present invention will now be further described in connection with the drawings, in which.

DETAILED DESCRIPTION OF THE INVENTION

The present invention provides a roll-changing apparatus for transporting and storing the rolls of a rolling machine comprising at least one roll set comprising at least two rolls having rotational axes thereof spaced apart and extending in a longitudinal direction, which roll-changing apparatus comprises a roll-changing truck, a roll exchanging truck, a roll rack facility and a roll-setting truck. The roll-changing truck is arranged to receive worn rolls from, and to deliver reconditioned rolls to, the rolling machine. The roll exchanging truck is arranged to receive the worn rolls from the roll-changing truck and to deliver the same to the roll rack and further to receive reconditioned rolls from the roll rack and deliver the same to the roll-changing truck. The worn and reconditioned rolls are stored on the roll rack facility. A roll-setting truck is provided to receive the worn rolls from the roll rack facility and deliver the same to a roll reconditioning shop and further to receive the reconditioned rolls from the roll reconditioning shop and deliver the same to the roll rack facility. The roll-changing truck, roll-exchanging truck and roll-setting truck each has its own course of travel.

In a roll-changing apparatus for carrying out transport and storage of the rolls of a rolling machine having at least a two-high rolling stand, the present invention provides an improved roll-changing apparatus composed of a plurality of racks, a roll-changing truck, a roll-exchanging truck, a roll rack facility and a roll-setting truck. Each said rack can hold a plurality of work rolls and intermediate rolls.

The roll changing truck carries a rack on which worn rolls from the rolling machine are loaded. It also receives reconditioned rolls from the roll-exchanging truck and delivers them to the rolling machine. The plurality of roll racks store the worn rolls and the reconditioned rolls, each rack storing rolls of one type or the other. The roll exchanging truck receives worn rolls from the roll changing truck and delivers them to the roll rack facility. It also receives worn rolls from a respective rack of the roll rack facility and delivers them to the roll changing truck.

The roll setting truck takes the worn rolls from a respective rack of the roll rack facility and delivers them to the roll reconditioning shop. It also delivers the reconditioned rolls from the reconditioning shop to the racks of the roll rack facility.

EXAMPLE

Figure 1:
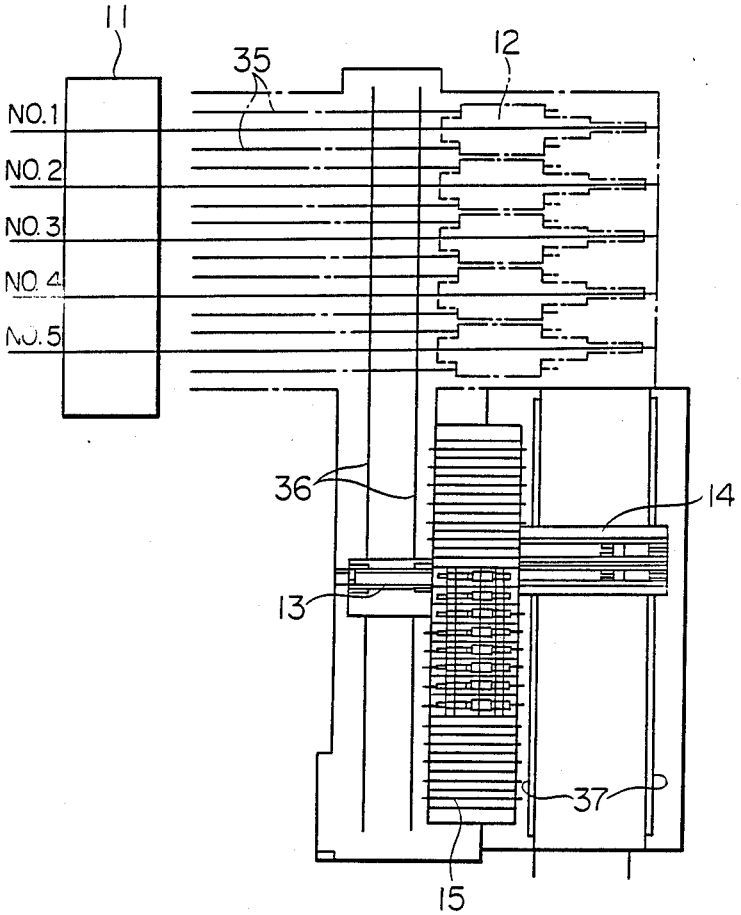
FIG. 1 is a plan view of a first embodiment according to the present invention.

Hereinafter, embodiments of the present invention will be described with reference to the drawings:

FIG. 1 is a plan view of a first embodiment according to the present invention, wherein a set of rails 36 for a roll-exchanging truck 13 are disposed on the leftside of a roll-changing truck 12, i.e., on the side of a rolling machine such that the roll-exchanging truck is movable to a position between the roll-changing truck and the rolling machine.

Figure 2:
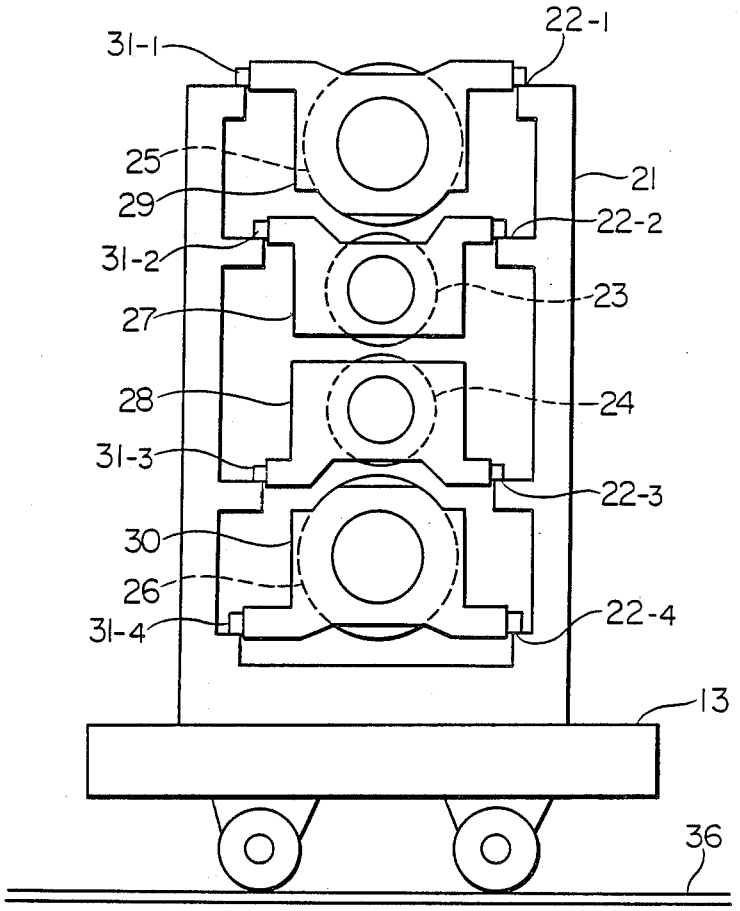
FIG. 2 is an explanatory view of a roll-exchanging truck viewed from the axial direction of the rolls.

When two work rolls and two intermediate rolls of the rolling machine require changing because of wear, etc., said rolls are drawn onto the roll-changing truck 12 by grasping the edges thereof with a push-puller (not illustrated) mounted on the roll-changing truck 12. Reference numeral 35 denotes a set of rails for supporting the roll-changing truck, the rails 35 extending in a direction parallel to the longitudinal direction. FIG. 2 is an explanatory view of the roll-exchanging truck 13 viewed from the axial direction of the rolls. The roll-exchanging truck has means thereon for transferring and supporting the rolls comprising a rack 21 provided with a plurality of set of rails comprising rail pairs 22-1 to 22-4, and work rolls 23, 24 and intermediate rolls 25, 26 are loaded on the rack 21 as supported on chocks 27 to 30 which have wheels 31-1 to 31-4 that ride on the rail pairs.

The roll-exchanging truck 13 is moved adjacent to and in alignment with the roll-changing truck 12 and the two work rolls and two intermediate rolls loaded on the roll-changing truck 12 are drawn onto the roll-exchanging truck 13 by grasping the edges thereof with a push-puller (not illustrated) mounted on the roll-exchanging truck 13.

The roll-changing truck 12 is provided with means for receiving and delivering the rolls comprising a rack of the same construction as that of the roll-exchanging truck 13. The structure of the roll exchanging truck 13 is such that when its center is aligned with that of the roll changing truck 12, the four pairs of rails of the respective trucks are connected with each other to enable transfer of rolls therebetween. After receiving the rolls from the roll-changing truck 12, the roll-exchanging truck 13 travels to the front of a prescribed portion of the roll rack facility 15. The roll rack facility 15 has means for storing sets of rolls comprising a plurality of racks, each of which has the same construction as that of the rack of the roll-exchanging truck 13 so that the rails can be connected by aligning the centers thereof.

The four rolls loaded on the roll-exchanging truck 13 are pushed forward onto a respective rack of the roll rack facility 15 by means of the push-puller (not illustrated) mounted on the roll-exchanging truck 13. The aforementioned roll transport can, of course, alternatively be applied to the work rolls only or the intermediate rolls only.

Worn rolls received on the roll rack facility 15 are cooled and washed and then left to stand by for grinding. When grinding is to be carried out, one of the rolls is drawn onto a roll-setting truck 14 disposed on the opposite side of the roll rack facility 15 from the roll-exchanging truck 13 by grasping said roll by means of a push-puller (not illustrated) mounted on the roll-setting truck 14. The roll-setting truck 14 includes means for supporting and transferring rolls comprising a set of rails which can be raised and lowered so as to connect with the respective rails of a respective one of the racks mounted on the roll rack facility 15. Accordingly, it is possible to transfer any roll desired. Reference numeral 37 denotes a set of rails on which the roll-setting truck 14 rides.

Next, the roll drawn onto the roll-setting truck 14 from the roll rack facility 15 is delivered to a roll reconditioning shop (not illustrated) where it is unloaded by means of a crane (not illustrated). Alternatively, the roll drawn onto the roll-setting truck 14 from the roll rack facility 15 may be directly transferred to the roll reconditioning shop by means of a crane.

After the roll has been ground at the roll reconditioning shop, it is transported by an operation that is the reverse of that just described. More specifically, the crane and the roll-setting truck 14 are used to place the reconditioned roll at a predetermined position on the roll rack facility 15 where it then rests together with the other work rolls or intermediate rolls. This completes the preparation for roll-changing. In roll-changing, the roll-exchanging truck 13 takes the reconditioned rolls from the roll rack facility 15 and then delivers the same to the roll-changing truck 12.

In transferring the roll between the roll-changing truck 12 and the rolling machine 11, the two are preferably positioned as close together as possible. Therefore, such auxiliary devices as the push-puller are disposed on the right side of the roll-changing truck, i.e. on the side opposite from that facing the rolling machine 11. Likewise, in transferring the roll between the roll-changing truck 12 and the roll-exchanging truck 13, the two are preferably positioned as close together as possible and said operations are performed from the side of the roll-changing truck 12 closer to the rolling machine 11.

According to the aforementioned method, however, the roll-exchanging truck 13 can enter into the roll-changing truck operating zone only after the roll-changing truck 12 has stopped at the roll transfer position at the end of the rails 35. As a result, the operation cycle time becomes long.

Figure 3:
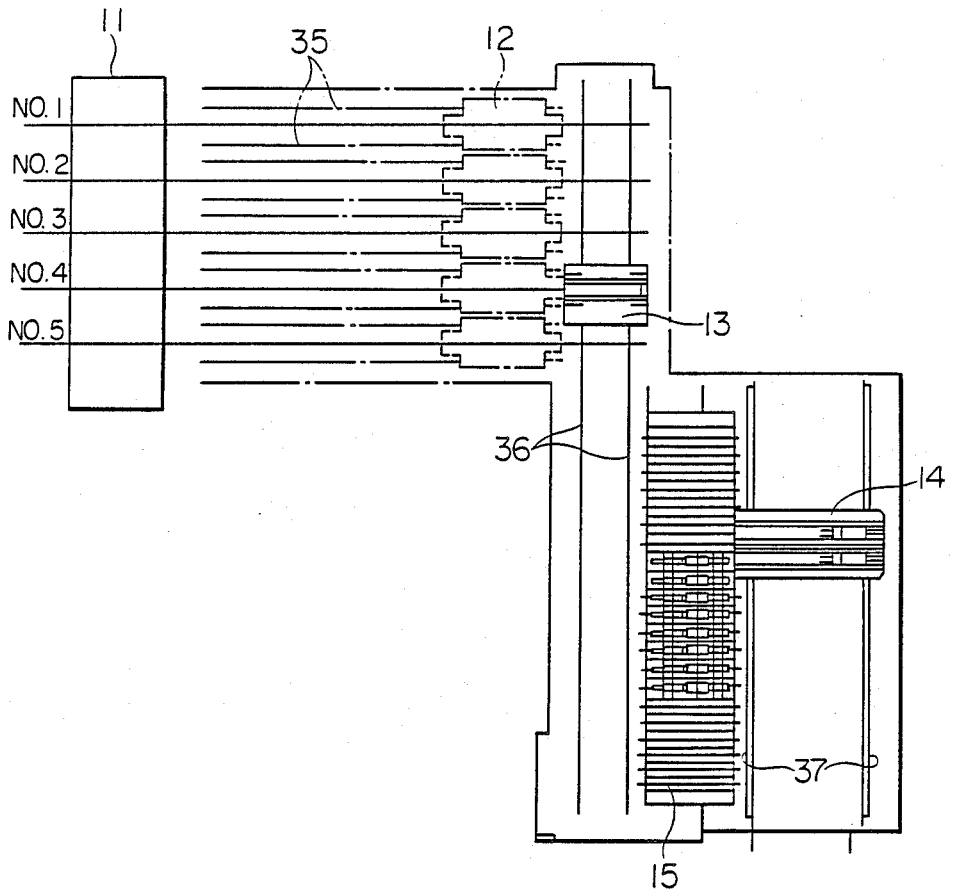
FIG. 3 is a plan view of a second embodiment according to the present invention.

FIG. 3 shows a second embodiment of the present invention. In this embodiment, the rails 36 for the roll-exchanging truck 13 which extend in a direction perpendicular to the longitudinal direction are disposed at the right side of the roll-changing truck 12, i.e. at the side opposite from the rolling machine such that the roll-changing truck 12 is between the rolling machine 11 and the roll-exchanging truck 13. Thus, the roll-exchanging truck 13 can stand by at the position for roll transfer and transfer of the rolls can begin immediately after the roll-changing truck 12 loaded with worn rolls at the rolling machine 11 arrives at the roll transfer position.

Here, however, it is necessary to design the trucks so that auxiliary devices such as the hydraulic cylinders, etc. of the push-pullers are mounted on the upper part or the side so that they will not interfere with each other.

Figure 4:
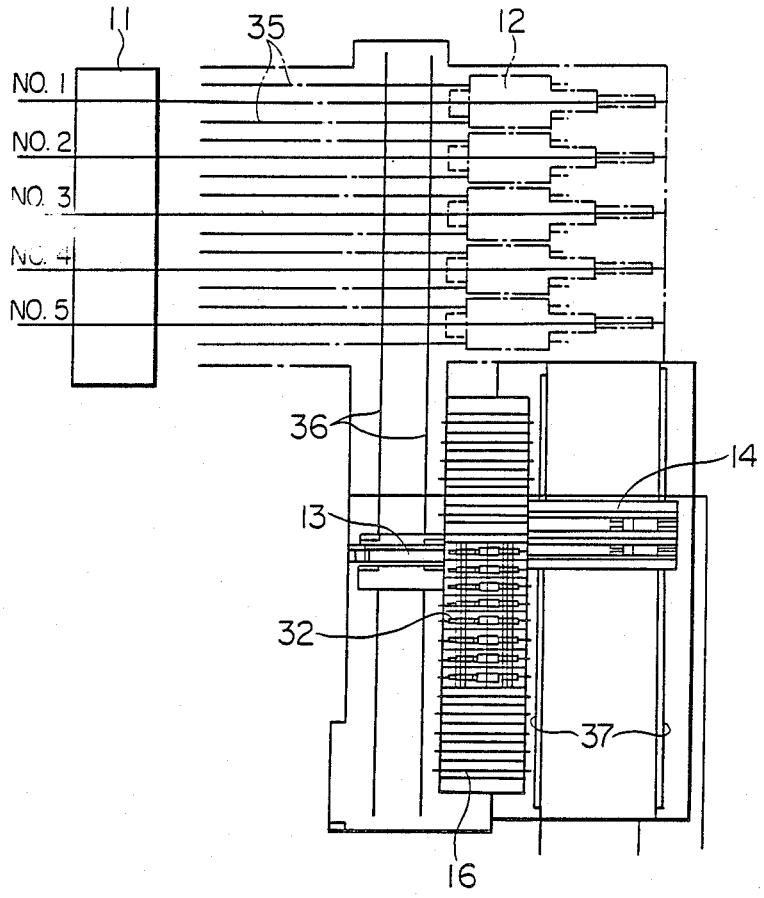
FIG. 4 is a plan view of a third embodiment according to the present invention.

FIG. 4 is a plan view of a third embodiment according to the present invention wherein a roll rack facility 16 is substituted for the roll rack facility 15 shown in FIG. 1. As described in more detail later, the roll rack facility 16 includes rails for receiving movable racks which can be exchanged between the roll rack facility 16 and the roll exchanging truck 13. Rails 36 for the roll-exchanging truck 13 are disposed at the left side of the roll-changing truck 12, i.e. on the side closer to the rolling machine 11. Alternatively, it is of course possible to dispose the rails 36 on the right side of the roll-changing truck 12, i.e. on the opposite side from the rolling machine 11 as in the case of the second embodiment. The advantages and disadvantages of this arrangement are the same as those described above.

When two work rolls and two intermediate rolls of the rolling machine 11 are to be changed, the rolls are drawn into the rack on the roll-changing truck 12 by grasping the edge thereof by means of a push-puller (not illustrated) mounted on the roll-changing truck 12.

Figure 5:
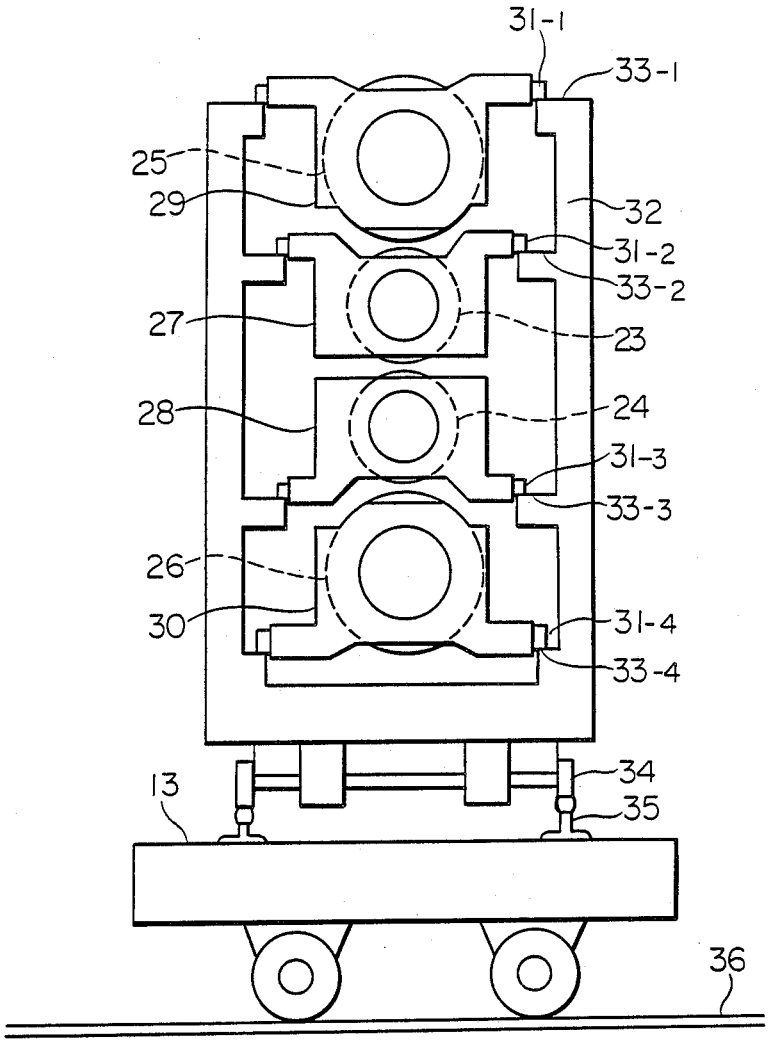
FIG. 5 is an explanatory view of another roll exchanging truck viewed from the axial direction of the rolls.

FIG. 5 is an explanatory view of the roll-exchanging truck 13 viewed from the axial direction of the rolls loaded thereon. Work rolls 23, 24 and intermediate rolls 25, 26 are independently supported on rails 33-1 to 33-4 of the rack 32 via wheels 31 mounted on the chocks 27, 28, 29, 30. Furthermore, means are provided on the roll-changing truck 12, the roll-exchanging truck 13 and a roll rack facility 16 for supporting and transferring the rolls, the means comprising wheels 34 of the rack and a set of rails on each of the roll-changing truck 12, the roll-exchanging truck 13 and the roll rack facility 16, one set of rails comprising rails 35 on the roll exchanging truck 13. Accordingly, the rack can move freely back and forth in directions parallel and perpendicular to the longitudinal direction.

The roll-exchanging truck 13 is moved in front of the roll-changing truck 12. The roll-changing truck 12 is provided with a set of rails similar to the rails 35 of the roll-exchanging truck 13. The rack 32 loaded with rolls is moved onto the roll-changing truck 12 from the roll-exchanging truck 13 by means of a push-puller (not illustrated) mounted on the roll-exchanging truck 13 and thereafter said rack is caused to travel to the roll rack facility 16.

The roll rack facility 16 also has a plurality of sets of rails matched to the wheels 34 mounted on the bottom of the rack 32 so that the rails 35 of the roll-exchanging truck 13 stopped in front of a prescribed position can be aligned with the rails of the roll rack facility 16. The roll rack on the roll-exchanging truck 13 is pushed onto the roll rack facility 16 by means of the push-puller mounted on the roll-exchanging truck 13.

The worn rolls delivered on the roll rack wait their turn for grinding. A roll is drawn out from an arbitrary one of the racks mounted on the roll rack facility 16 by the push-puller mounted on the roll-setting truck 14 positioned on the opposite side of the roll rack facility 16 from the roll-exchanging truck 13. The set of rails of the roll-setting truck 14 can be moved vertically so as to align with the rails 33 of the respective racks.

The rolls drawn out onto the roll-setting truck 14 are delivered to the roll reconditioning shop by a crane (not illustrated). The rolls ground at the roll reconditioning shop are delivered to the rolling mill via the crane—the roll-setting truck 14—the roll rack facility 16 (storage-)—the roll-exchanging truck—the roll-changing truck 12, in the reverse order from that described above.

According to the present invention, the following effects can be obtained:

1. Roll-transfer between the roll-changing truck 13 and the roll storage shed can be performed by a minimum member number of operators, generally without need for any operator at all.

2. Even where the roll-setting truck 14 and roll storage shed are arranged separately, the transport of the roll can be performed without receiving and delivering the roll between the two separated houses by employing the roll-exchanging truck 13 and thus the layout of the roll-changing equipment can be freely decided.

3. Since the work rolls and intermediate rolls of one or more stands can be transported at one time, the time required for loading the ground rolls onto the roll-changing truck 12 and for unloading the worn rolls from the roll-changing truck 12 can be shortened. While the present invention has been described with reference to the foregoing embodiments, it will be understood by those skilled in the art that various changes and modifications may be made thereto which fall within the scope of the appended claims.

What is claimed is:

1. An apparatus for changing rolls of a rolling machine having at least one roll set comprising at least two rolls having rotational axes extending in a longitudinal direction, comprising:

at least one roll-changing truck having means thereon for receiving worn rolls from the roll set of the rolling machine and delivering reconditioned rolls to the rolling machine;

a roll rack facility having means thereon for storing sets of rolls for the rolling machine at respective positions located along the length of the roll rack facility with the rotational axes of the rolls oriented perpendicular to opposite sides of the roll rack facility, the roll rack being spaced from an operating zone of the roll-changing truck;

a roll-exchanging truck supported for movement back and forth between respective positions adjacent the roll-changing truck and one of the opposite sides of the roll rack facility, the roll-exchanging truck having means thereon for supporting a plurality of the rolls for the rolling machine and for transferring at least one of the rolls supported thereon to the roll-changing truck when the roll-exchanging truck is positioned adjacent the roll-changing truck and to the roll rack facility when the roll-exchanging truck is positioned adjacent the one side of the roll rack facility in alignment with one of the respective positions located along the length of the roll rack facility at which one of the roll sets can be stored; and a roll-setting truck supported for movement along the other one of the opposite sides of the roll rack facility, the roll-setting truck including means thereon for supporting one of the rolls of the rolling machine and transferring the one roll supported thereon to the roll rack facility and for transferring one of the rolls supported on the roll rack facility to the roll-setting truck.

2. The apparatus of claim 1, wherein the means on the roll-changing truck for receiving and delivering rolls comprises a rack having a plurality of vertically spaced-apart sets of rails, each of the sets of rails comprising means for supporting a respective one of the rolls of the roll set whereby each of the rolls of the roll set can be loaded into and removed from the rolling machine by moving each of the rolls in a direction coincident with its rotational axis.

3. The apparatus of claim 2, wherein the means on the roll-setting truck for supporting and transferring the one roll comprises a set of rails mounted on the roll-setting truck for movement between vertically spaced-apart positions in alignment with each of the sets of rails of a respective one of the racks mounted on the roll rack facility.

4. The apparatus of claim 3, wherein the at least one rack comprises a plurality of racks, the roll rack facility including a set of rails for supporting and guiding each of the racks when each of the racks is transferred from the roll-exchanging truck to the roll rack facility and from the roll rack facility to the roll exchanging truck.

5. The apparatus of claim 1, wherein the means on the roll rack facility for storing sets of rolls comprises a plurality of racks, each of the racks having a plurality of vertically spaced-apart sets of rails for holding one of the sets of rolls, each of the sets of rails comprising means for supporting a respective one of the rolls of one of the sets of rolls.

6. The apparatus of claim 1, wherein the means on the roll-exchanging truck for supporting and transferring the rolls comprises a rack having a plurality of vertically spaced-apart sets of rails, each of the sets of rails comprising means for supporting a respective one of the rolls of the roll set.

7. The apparatus of claim 1, wherein each of the means on the roll-changing truck, the roll-exchanging truck and the roll rack facility comprises at least one rack supported for movement between the roll-changing truck and the roll-exchanging truck and between the roll-exchanging truck and the roll rack facility, each of the roll-changing truck, the roll-exchanging truck and the roll rack facility including a respective set of rails thereon for supporting and guiding the rack between the roll-changing truck and the roll-exchanging truck when the set of rails on the roll-changing truck are aligned with the set of rails on the roll-exchanging truck and between the roll-exchanging truck and the roll rack facility when the set of rails on the roll-exchanging truck are aligned with the set of rails on the roll rack facility.

8. The apparatus of claim 7, wherein the rack includes a plurality of vertically spaced-apart sets of rails, each of the sets of rails comprising means for supporting a respective one of the rolls of the roll set whereby each of the rolls of the roll set can be loaded into and removed from the rolling machine by moving each of the rolls in a direction coincident with its rotational axis.

9. The apparatus of claim 1, wherein the at least one roll-changing truck comprises a plurality of roll-changing trucks, each of which is supported for movement to a position adjacent the location of a respective roll set of the rolling machine for transferring used and reconditioned rolls to and from the rolling machine, the roll-exchanging truck being supported for movement to positions adjacent each of the roll-changing trucks for transferring rolls back and forth between a respective one of the roll-changing trucks and the roll-exchanging truck.

10. The apparatus of claim 1, wherein the roll-changing truck is supported for movement on a set of rails extending parallel to the longitudinal direction and the roll-exchanging truck and the roll-setting truck are each supported for movement on a respective set of rails extending perpendicular to the longitudinal direction.

11. The apparatus of claim 1, wherein the roll-exchanging truck is supported for movement to a position between the roll-changing truck and the rolling machine.

12. The apparatus of claim 1, wherein the roll-exchanging truck is supported for movement to a position at which the roll-changing truck is between the rolling machine and the roll-exchanging truck.

* * * * *